US007698778B2

(12) United States Patent
Poetting

(10) Patent No.: US 7,698,778 B2
(45) Date of Patent: Apr. 20, 2010

(54) VACUUM CLEANER HAVING A MOTOR-FAN UNIT AND A FINE FILTER DISPOSED IN AN EXHAUST AIR STREAM THEREOF

(75) Inventor: Michael Poetting, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 12/199,461

(22) Filed: Aug. 27, 2008

(65) Prior Publication Data

US 2009/0056062 A1 Mar. 5, 2009

(30) Foreign Application Priority Data

Aug. 30, 2007 (DE) ..... 10 2007 040 963

(51) Int. Cl.
*A47L 9/00* (2006.01)

(52) U.S. Cl. ..... 15/347; 15/350; 15/351

(58) Field of Classification Search ..... 15/347, 15/350, 351, 352, 353; *A47L 9/10*
See application file for complete search history.

(56) References Cited

U.S. PATENT DOCUMENTS 6,256,834 B1 * 7/2001 Meijer et al. ..... 15/352
2003/0167590 A1 * 9/2003 Oh ..... 15/347

FOREIGN PATENT DOCUMENTS

| | | |
|---|---|---|
| DE | 4240172 | 6/1994 |
| DE | 20207256 | 9/2003 |

* cited by examiner

*Primary Examiner*—David A Redding
(74) *Attorney, Agent, or Firm*—Darby & Darby

(57) ABSTRACT

A vacuum cleaner includes a motor-fan unit and a housing part including a filter receptacle. A filter frame is slidably insertable in an insertion direction into the filter receptacle so as to be disposed in an exhaust air stream of the motor-fan unit. The filter frame has a substantially parallelepiped configuration and is configured to receive a fine filter. The vacuum cleaner includes an air-permeable cover element pivotably disposed on the housing and configured to cover the filter receptacle. The cover element is operable to redirect force resulting from a pivoting movement thereof from the insertion direction to a pressing direction substantially perpendicular to the insertion direction so as to press an edge contour of the filter frame toward a mating contour of the filter receptacle in an inserted position of the filter frame.

13 Claims, 4 Drawing Sheets

VACUUM CLEANER HAVING A MOTOR-FAN UNIT AND A FINE FILTER DISPOSED IN AN EXHAUST AIR STREAM THEREOF

CROSS REFERENCE TO RELATED APPLICATIONS

Priority is claimed to German patent application DE 10 2007 040 963.1, filed Aug. 30, 2007, which is hereby incorporated by reference herein.

FIELD

The present invention relates to a vacuum cleaner including a motor-fan unit which has disposed in its exhaust air stream a cartridge-like filter frame insertable in the manner of a drawer into a filter receptacle of a housing part of the vacuum cleaner.

A vacuum cleaner having a fine filter is described, for example, in DE 42 40 172 C2. In that patent, a filter mat designed as a fine-particulate or hygienic filter is disposed in a cartridge-like holder. In the vacuum cleaner described in DE 42 40 172 C2, which is hereby incorporated by reference herein, the holder is placed flat onto the air outlet of the fan. The force required to achieve a sealing effect is produced by projecting portions of a cover, which are produced when a housing cover is pivoted onto a peripheral flange.

In addition to the above-described flat mounting position of a filter cartridge, DE 202 07 256 UI describes sliding a filter cartridge in the manner of a drawer into a receptacle provided for this purpose. Such a drawer-type receptacle may be useful when there is insufficient space for a flat receptacle. A disadvantage of this holder is that in order to obtain the sealing effect, contact-pressure must be exerted in a direction perpendicular to the insertion direction. In DE 202 07 256 U1, the required pressing force to be exerted on the cartridge, or on the seal thereof, is produced by sloping control segments cooperating with a mating control surface which is also sloped. When inserting the cartridge, the seal is stressed both in the pressing direction and in the insertion direction. This causes wear of the seal and, in the worst case, the adhesive bond between the filter frame and the seal fails, and the seal is moved from its seat to a region outside the intended contact area.

SUMMARY

In view of the above, an aspect of the present invention is to provide a vacuum cleaner wherein damage to the sealing surface is reduced or prevented while, at the same time, sufficient contact pressure is exerted on the filter frame.

In an embodiment, the present invention provides a vacuum cleaner with a motor-fan unit and a housing part including a filter receptacle. A filter frame is slidably insertable in an insertion direction into the filter receptacle so as to be disposed in an exhaust air stream of the motor-fan unit. The filter frame has a substantially parallelepiped configuration and is configured to receive a fine filter. The vacuum cleaner includes an air-permeable cover element pivotably disposed on the housing and configured to cover the filter receptacle. The cover element is operable to redirect force resulting from a pivoting movement thereof from the insertion direction to a pressing direction substantially perpendicular to the insertion direction so as to press an edge contour of the filter frame toward a mating contour of the filter receptacle in an inserted position of the filter frame.

BRIEF DESCRIPTION OF THE DRAWINGS

An exemplary embodiment of the present invention will be described in more detail below and is shown schematically in the drawings, in which.

DETAILED DESCRIPTION

The present invention relates to a vacuum cleaner including a motor-fan unit which has disposed in its exhaust air stream a cartridge-like filter frame of substantially rectangular parallelepiped configuration for receiving a fine filter; said filter frame being insertable in the manner of a drawer into a filter receptacle of a housing part of the vacuum cleaner and, when inserted, being able to be pressed with an edge contour against a mating contour of the filter receptacle, possibly with a seal interposed therebetween; and the direction of movement for inserting the filter frame being substantially perpendicular to the direction in which the pressing force is applied.

In an embodiment, the present invention provides a pivotably mounted cover element which covers the filter receptacle when the filter frame is in the inserted position and which causes the force resulting from the pivoting movement to be redirected from the insertion direction to the pressing direction. This prevents wear of the edge contour and/or of the seal. Furthermore, the cover element can be used as a lever. In this manner, the forces that the user has to exert to obtain the sealing effect are kept low.

In an embodiment, first retaining means in the form of a projection are provided on at least a portion of the edge contour, said first retaining means cooperating with second retaining means in the form of a recess in the lower region of the filter receptacle. This ensures that the filter frame performs a defined pivoting movement about the retaining means when the cover is being closed. As the frame is being pressed against the contour of the filter receptacle, any relative movement perpendicular to the pressing direction is prevented.

In order to achieve sufficient contact pressure, the cover element may include at least one pressure rib having a curved contour.

Since the cover element is retained in the closed position by self-locking action, there is no need for any additional closure means.

The seal may be disposed on the edge contour of the filter frame.

In an embodiment of an upright vacuum cleaner, the motor-fan unit and the filter receptacle can be mounted in a base unit. This allows for easy filter replacement and provides short air paths from the fan to the fine filter.

Figure 1:
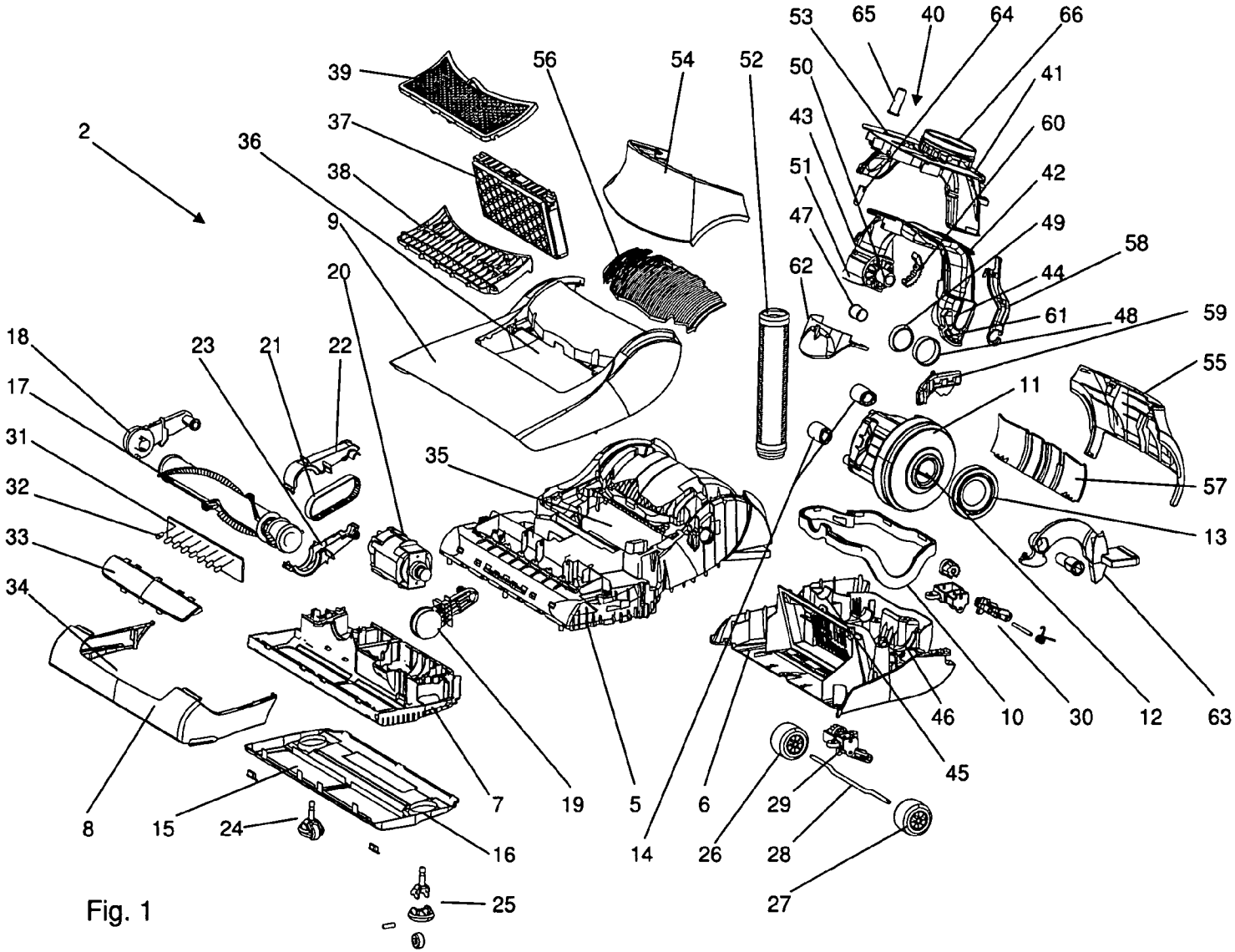
FIG. 1 is an exploded view showing the base unit of an upright vacuum cleaner.

FIG. 1 shows, in an exploded view, base unit 2 of an upright vacuum cleaner, said base unit having a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor-fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor-fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Both the tilting joint and the swivel joint between base unit 2 and an upper body are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is formed by two plastic parts, namely an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members or skirts 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable is secured to bridge portion 53. To enable the upright to be locked in the upright position, a foot pedal 63 is mounted on housing insert 5 which, in this position, engages with left yoke end 44, thereby preventing yoke 40 from swiveling. The locked position can be released by depressing pedal 63. Moreover, in the locked position, swivel motion is prevented by two spring-mounted pins 64 and 65. In the region of bridge portion 53, the air passages provided by yoke ends 43 and 44 are combined into a first section 66 of a coaxial conduit.

Figure 2:
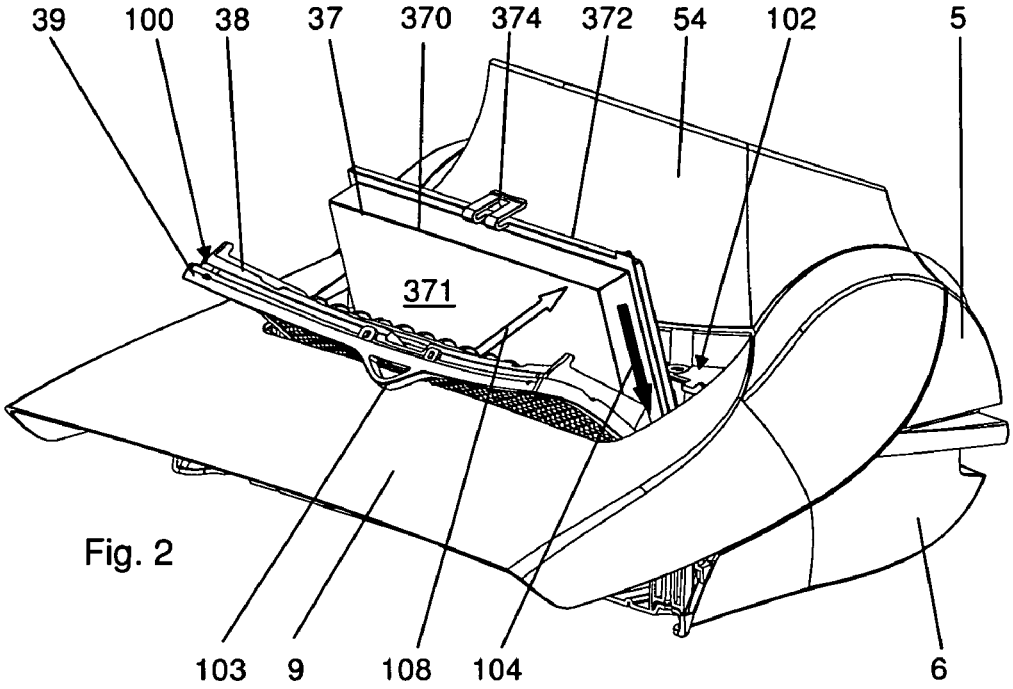
FIG. 2 is a view showing components of the base unit.
Figure 3A:
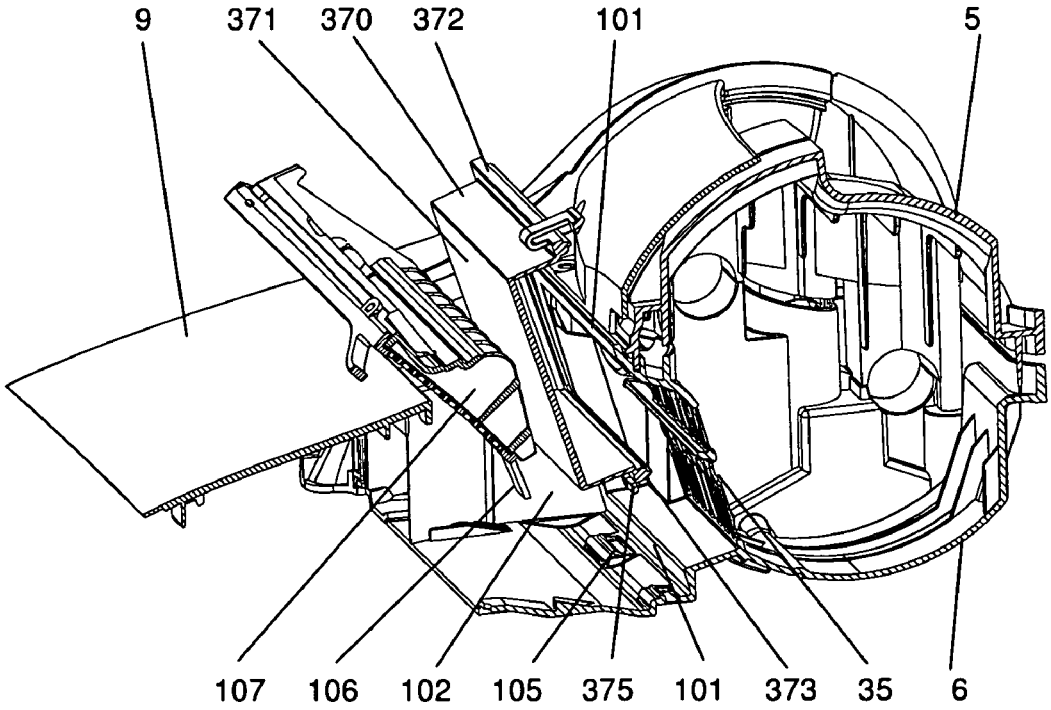
FIGS. 3*a* through 3*e* are cross-sectional views showing components of the base unit in different stages during insertion of the filter frame.

FIG. 2 shows the rear portion of base unit 2, including cover part 9, front cover 54, lower rear housing part 6, and housing insert 5. Grating holder 38 and a grating 39 are joined to form an air-permeable cover element (hereinafter referred to as closure 100), and hinged to cover part 9. When assembled, lower rear housing part 6 and housing insert 5 together form the chamber for receiving motor-fan unit 11 and the opening 35 for the exhaust air stream thereof. Opening 35 is surrounded by a rectangular contour 101. Furthermore, when assembling the two subassemblies, a filter receptacle 102 is created, into which filter frame 37 can be inserted along with the fine filter in the manner of a drawer. Shown are only the general features of filter frame 37, namely side walls 370, rear wall 371, edge contour 372, and seal 373. The remainder of the construction may be similar to that described in DE 42 40 172 C2, and, therefore, is not further described. When inserting the filter frame, first the closure 100 is pivoted rearward by pulling on a handle 103 provided for this purpose. Then, filter frame 37, together with the fine filter placed therein, is inserted into filter receptacle 102 in the direction of black arrow 104 (see FIGS. 2 and 3*a*). For increased ease of handling and to prevent inverted insertion, a gripping tab 374 is formed on one side wall of filter frame 37.

Figure 3B:
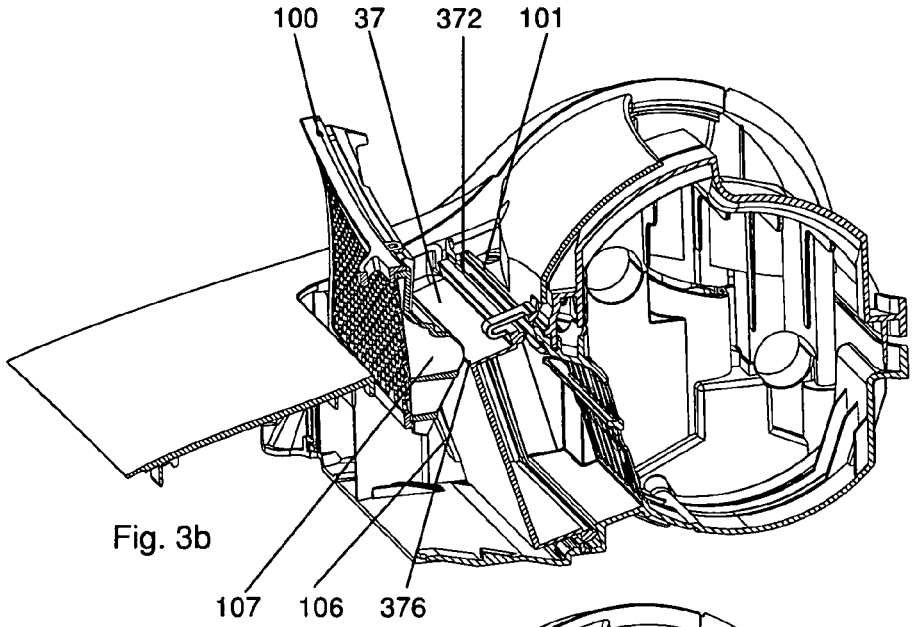

To ensure that the lower portion of frame 37 is placed in a defined position, the side of the edge contour 372 opposite tab 374 has projections 375 which are associated with recesses in the lower region of filter receptacle 102. Housing insert 5 has formed thereon guide segments 106 which enable projections 375 to reliably slide toward recesses 105 during the insertion of frame 37. After filter frame 37 has fallen to the position shown in FIG. 3*b* due to its own weight, the procedure for closing closure 100 begins. To this end, the closure is pivoted in a clockwise direction. First, integrally formed pressure ribs 107 press against the edge 376 between upper side wall 370 and rear wall 371. In this manner, filter frame 37 is pushed down until projections 375 are received by recesses 105. The slope of the guide segments 106 and the depth of recesses 105 are selected such that seal 373 engages contour 101 only after the insertion process is completed.

Figure 3C:
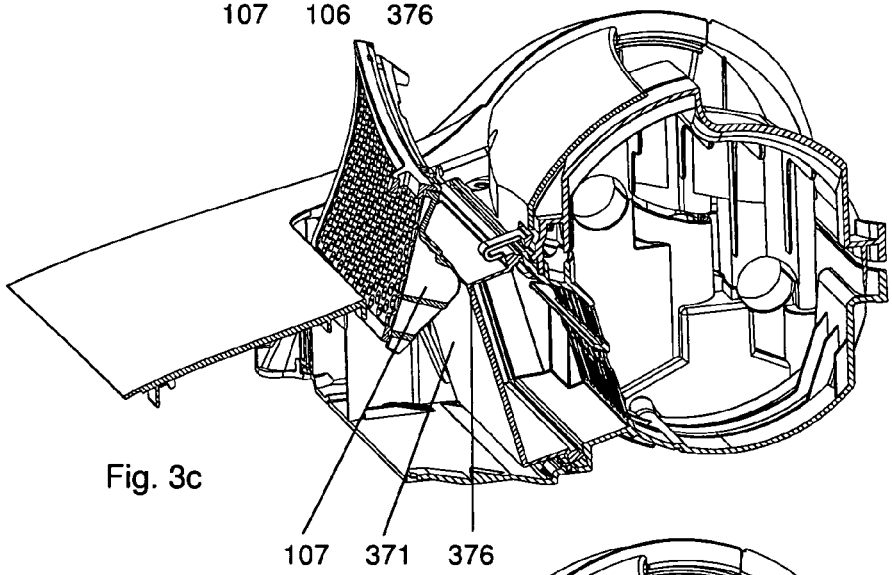

As the closure is pivoted further (FIG. 3*c*), the contact point of pressure ribs 107 moves from edge 376 onto rear wall 371 because of the curved contour of said pressure ribs. Thus, filter frame 37 is pressed with the entire seal 373 against contour 101 in the direction of white arrow 108 (see FIG. 2), i.e., perpendicular to the insertion direction, in the manner of a toggle mechanism.

Figure 3D:
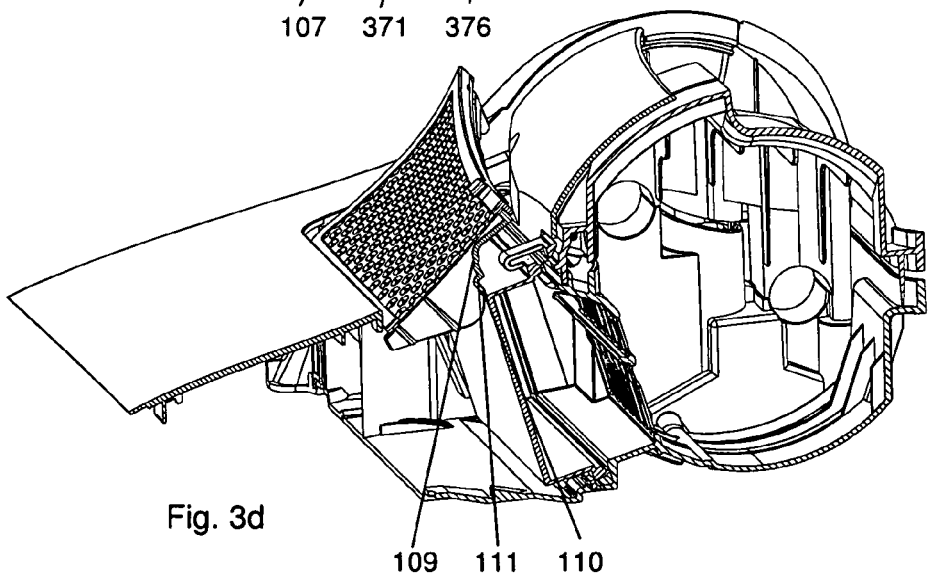
Figure 3E:
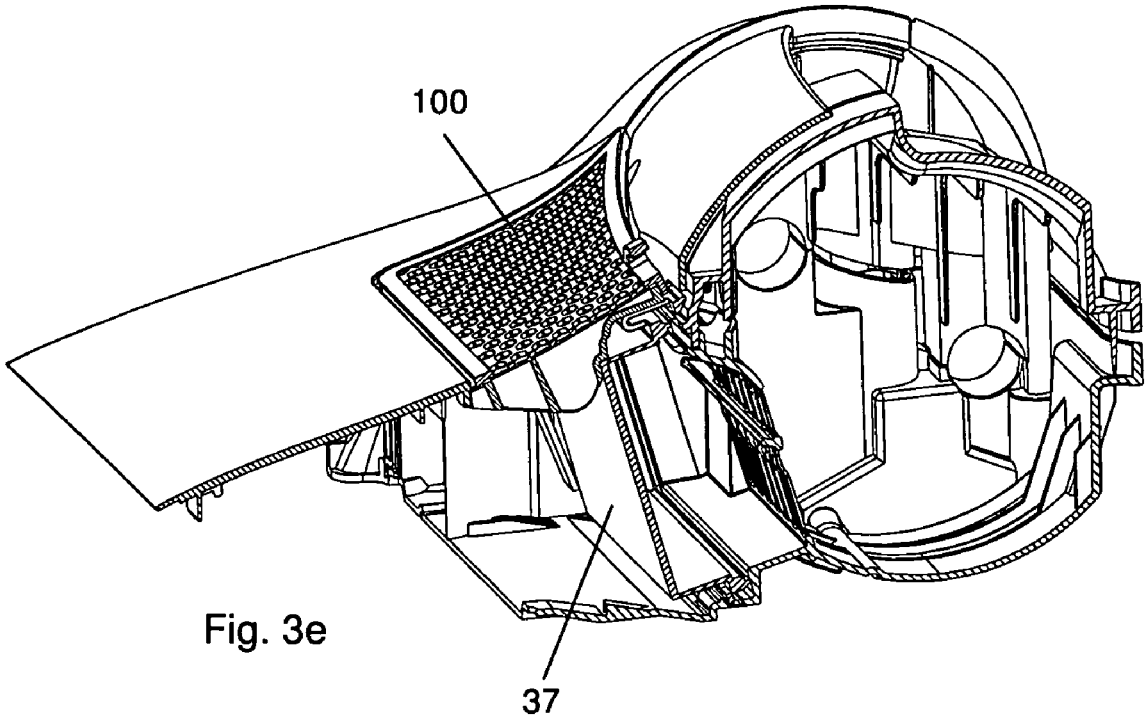

The curved contour of pressure ribs 107 merges into reinforcements 109 having a slope 110, which further increase the pressure against the rear wall shortly before the end of the pivoting operation (FIG. 3*d*). The adjoining straight run-out portion 111 provides a self-locking action when closure 100 is in the closed position (FIG. 3*e*). When closure 100 is opened, filter frame 37 is immediately released and can easily be removed.

The present invention has been described herein based on one or more exemplary embodiments, but is not limited thereto. Reference should be had to the appended claims.

What is claimed is:

1. A vacuum cleaner comprising:

a motor-fan unit;

a housing part including a filter receptacle;

a filter frame slidably insertable in an insertion direction into the filter receptacle so as to be disposed in an exhaust air stream of the motor-fan unit, the filter frame having a substantially parallelepiped configuration and being configured to receive a fine filter; and an air-permeable cover element pivotably disposed on the housing and configured to cover the filter receptacle, the cover element operable to redirect force resulting from a pivoting movement thereof from the insertion direction to a pressing direction substantially perpendicular to the insertion direction so as to press an edge contour of the filter frame toward a mating contour of the filter receptacle in an inserted position of the filter frame.

2. The vacuum cleaner as recited in claim 1, wherein the filter frame has a form of a cartridge.

3. The vacuum cleaner as recited in claim 1, wherein the vacuum cleaner is an upright vacuum cleaner.

4. The vacuum cleaner as recited in claim 1, further comprising a seal disposed between the edge contour of the filter frame and the mating contour of the filter receptacle in the inserted position of the filter frame.

5. The vacuum cleaner as recited in claim 1 wherein at least a portion of the edge contour includes a first retaining device configured to cooperate with a second retaining device disposed on a lower region of the filter receptacle.

6. The vacuum cleaner as recited in claim 1 wherein the edge contour includes at least one projection configured to cooperate with at least one recess in a lower portion of the filter receptacle so as to retain the filter frame in the filter receptacle.

7. The vacuum cleaner as recited in claim 1 wherein the cover element includes at least one pressure rib having a curved contour.

8. The vacuum cleaner as recited in claim 5 wherein the cover element includes at least one pressure rib having a curved contour.

9. The vacuum cleaner as recited in claim 1 wherein the cover element is configured to be self-lockingly retained in a closed position.

10. The vacuum cleaner as recited in claim 1 further comprising a seal disposed on an edge of the contour of the filter frame against the mating contour of the filter receptacle in the inserted position of the filter frame.

11. The vacuum cleaner as recited in claim 1 further comprising a base unit, and wherein the motor-fan unit and the filter receptacle are disposed in the base unit.

12. The vacuum cleaner as recited in claim 1 wherein the cover element is configured to cover the filter frame when the filter frame is in the inserted position.

13. The vacuum as recited in claim 1 wherein the cover element is operable to redirect force resulting from a pivoting movement thereof from the insertion direction to a pressing direction substantially perpendicular to the insertion direction so as to press an edge contour of the filter frame against a mating contour of the filter receptacle in the inserted position of the filter frame.

* * * * *